US005562316A

United States Patent [19]

Bullock et al.

[11] Patent Number: 5,562,316

[45] Date of Patent: Oct. 8, 1996

[54] BAR LOCK

[75] Inventors: Charles E. Bullock, Waukegan; William S. Hansen, II, Mettawa, both of Ill.

[73] Assignee: A. L. Hansen Mfg. Co., Waukegan, Ill.

[21] Appl. No.: 382,845

[22] Filed: Feb. 3, 1995

[51] Int. Cl.[6] ..... E05C 3/04

[52] U.S. Cl. ..... 292/202; 292/259 R; 292/DIG. 32

[58] Field of Search ..... 292/DIG. 32, 194, 292/205, 241, 202, 210, 259 R

[56] References Cited

U.S. PATENT DOCUMENTS

| | | | |
|---|---|---|---|
| 1,989,781 | 2/1935 | Zak | 292/259 X |
| 2,297,007 | 9/1942 | Lounsbury | 292/DIG. 32 X |
| 3,002,800 | 10/1961 | McMahan | 292/259 R |
| 3,281,177 | 10/1966 | Tenebaum | 292/202 X |
| 3,370,877 | 2/1968 | Hallberg | 292/DIG. 32 X |
| 4,397,488 | 8/1983 | Pastra | 292/210 |
| 5,046,770 | 9/1991 | Hansen . | |

*Primary Examiner*—Rodney M. Lindsey
*Attorney, Agent, or Firm*—Brinks Hofer Gilson & Lione

[57] ABSTRACT

A bar lock for securing a door in a closed position in a frame includes a bar that forms a first interlocking profile extending along its length. The bar is mounted for rotation in first and second hinges by first and second hinge elements. The first and second hinge elements define a second interlocking profile shaped to mate with the first interlocking profile to restrict the hinge elements to axial movement along the length of the bar. The interlocking profiles maintain alignment and facilitate welding of the hinge elements in place on the bar. A similar approach can be used to facilitate assembly of a handle bracket to the bar. An elastomeric strip is affixed in a groove extending along the length of the bar to cushion contact between the bar and the door.

15 Claims, 2 Drawing Sheets

Fig. 2
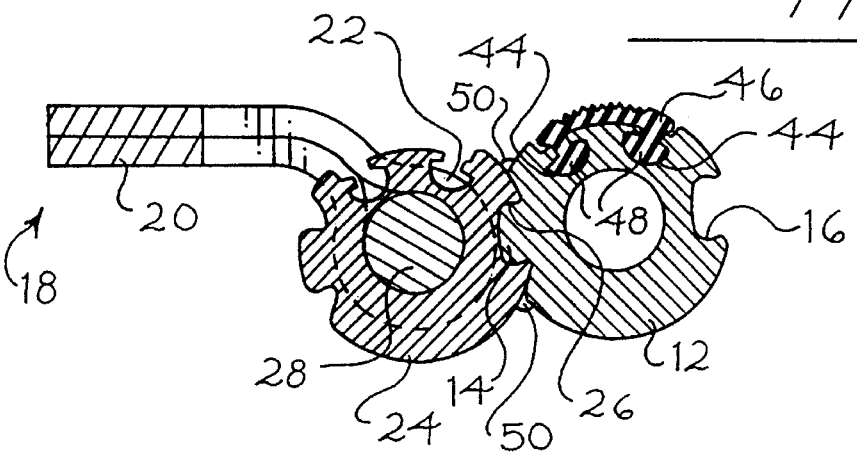
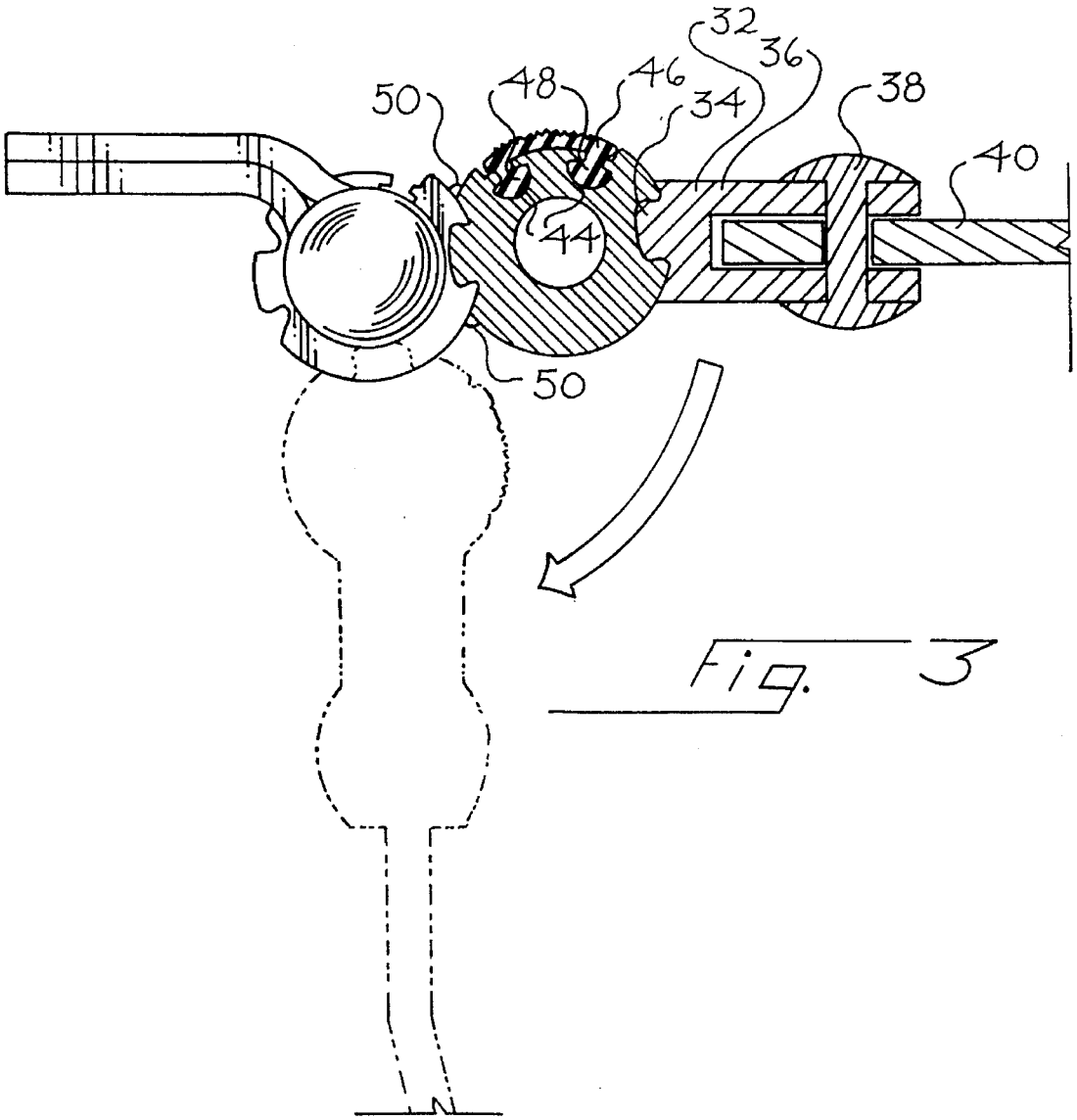
Fig. 3

BAR LOCK

BACKGROUND OF THE INVENTION

This invention relates to an improved bar lock for securing a door in a closed position in a frame.

Bar locks are well known to those skilled in the art. See for example the bar lock described in Hansen U.S. Pat. No. 5,046,770, assigned to the assignee of this invention. Such bar locks are typically fabricated from a number of separate components that are welded or pinned together. If the components are welded together, it is customary to provide fixtures that hold the various components in the desired assembled relationship for the welding operation.

This invention is directed to an improved bar lock that substantially reduces the fixtures required for assembly and welding.

SUMMARY OF THE INVENTION

According to this invention, a bar lock is provided for securing a door in a closed position in a frame. The bar lock includes a bar having a first interlocking profile extending along its length. First and second hinges are provided, including respective first and second hinge elements. Each hinge element comprises a second interlocking profile. The second interlocking profile is shaped to mate with the first interlocking profile to restrict the hinge elements to axial movement along the length of the bar. Typically, the hinge elements are secured against axial movement along the bar by fasteners such as welds.

BRIEF DESCRIPTION OF THE DRAWINGS

FIG. 2 is a cross-sectional view taken along line 2—2 of FIG. 1.

FIG. 3 is a cross-sectional view taken along line 3—3 of FIG. 1.

DETAILED DESCRIPTION OF THE PRESENTLY PREFERRED EMBODIMENTS

Figure 1:
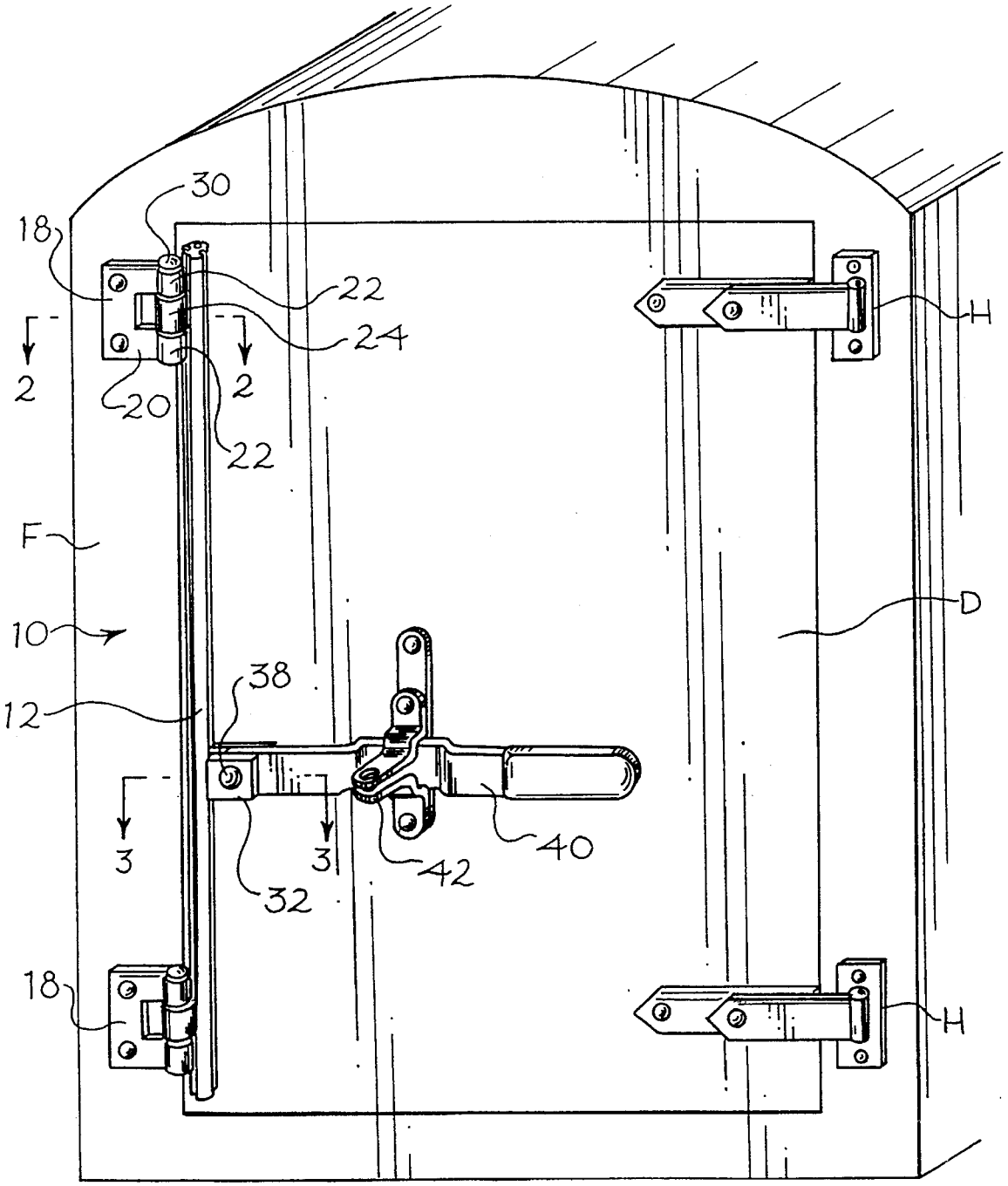
FIG. 1 is a perspective view showing a preferred embodiment of the bar lock of this invention mounted on the door of a vehicle.

Turning now to the drawings, FIG. 1 shows a bar lock 10 which incorporates a presently preferred embodiment of this invention mounted to a frame F adjacent to a door D of a vehicle. The door D in this embodiment is a single door that is pivotably movable within the frame F by means of conventional hinges H. Though the bar lock is described for use with a single door as shown in FIG. 1, it should of course be understood that the invention can readily be adapted to multiple door closures, such as the multiple door closure shown in the above-referenced Hansen U.S. Pat. No. 5,046,770.

As shown in FIG. 1, the bar lock 10 includes a bar 12 which is pivotably mounted on hinges 18 and which supports a handle bracket 32 and a handle 40.

As best shown in FIG. 2, the bar 12 includes a protruding ridge 14 and a recessed groove 16. Both the ridge 14 and the groove 16 extend axially along the entire length of the bar 12, which in this embodiment is formed as an extrusion of a suitable alloy such as an aluminum alloy.

Each of the hinges 18 includes a hinge plate 20 which is formed to define two colinear, spaced apart sleeves 22. A hinge element 24 is mounted for pivotal movement between the sleeves 22 by a pin 28 (FIG. 2). The pin 28 has an enlarged head 30 at each end, so as to form a nonremovable pin. For example, the heads 30 can be peened portions of the pin 28.

In this embodiment, in order to minimize cost, the hinge elements 24 have a cross-sectional shape identical to that of the bar 12. In fact, the hinge elements 24 are preferably formed from a shorter length of the same extrusion as that used to form the bar 12. Each hinge element 24 defines a groove 26. The ridge 14 and the groove 26 are formed as mating interlocking surfaces. Preferably, the ridge 14 has a dovetail shaped as shown, as does the groove 26. The interlocking surfaces formed by the ridge 14 and the groove 26 allow the hinge element 24 to slide along the length of the bar 12, while substantially preventing any relative movement between these two parts other than movement in the axial or lengthwise direction.

As shown in FIG. 3, the handle bracket 32 defines an axially extending dovetail ridge 34 and a clevis 36. The handle bracket 32 can also be formed as an extrusion of a suitable metal such as for example a suitable aluminum alloy. The ridge 34 and the groove 16 form mating interlocking surfaces which allow the handle bracket 32 to slide along the length of the bar 12 while substantially preventing any relative movement therebetween other than axial sliding motion. In this embodiment, the ridge 34 is substantially identical in shape to the ridge 14.

A handle 40 is pivotably mounted to the handle bracket 32 by a pin 38. The handle 40 can be releasably secured in place on the door D by a conventional handle lock 42. For example, the handle lock 42 can be formed in a manner substantially identical to that shown in FIG. 4 of the above-identified Hansen U.S. Pat. No. 5,046,770.

As best shown in FIGS. 2 and 3, the bar 12 also defines a pair of grooves 44 extending along the length thereof. A resilient elastomeric strip 46 is provided, and the strip 46 defines two generally T-shaped ridges 48, each shaped to fit within and to be retained by a respective one of the grooves 44.

The bar lock 10 is easily assembled in a correct geometry for welding. This can be accomplished simply by sliding the hinge elements 24 and the handle bracket 32 to the correct axial positions along the length of the bar 12. Once this has been done, the hinge elements 24 and the handle bracket 32 can be secured in place by any suitable fastener, as for example by tack welds 50 between the bar 12 and the hinge elements 24 and between the bar 12 and the handle bracket 32. Note that the interlocking ridges and grooves of the bar 12, the hinge elements 24, and the handle bracket 32 ensure that these parts are properly positioned circumferentially about the bar 12, and that the hinge elements 34 are therefore substantially co-linear. This simplifies alignment and ensures that the component elements of the bar lock 10 can be simply and reliably assembled in the desired spatial relationship.

Once the hinge elements 24 and the handle bracket 32 have been secured to the bar 12, the remaining components can be assembled. Alternately, the hinge elements 24 can be assembled in the hinges 18 before the hinge elements 24 are secured to the bar 12. The elastomeric strip 46 can be installed in the grooves 44. The elastomeric strip 46 prevents metal-to-metal contact between the bar 12 and the door D and thereby reduces wear and noise.

Of course, many changes and modifications can be made to the preferred embodiment described above. As mentioned, the bar lock 10 can be adapted for use with multiple door (including double door) applications. In this case, a suitable cam latch can be added at each end of the bar 12. If desired, the above-described mechanical interlock between the hinge element 24 and the bar 12 can be used without any comparable mechanical interlock between the handle bracket 32 and the bar 12. Of course, the ridges and grooves described above can be modified as to size and shape to fit the particular application. For example, T-slots and T-shaped ridges can be substituted for the dovetail grooves and dovetail ridges described above. Additionally, materials can be selected as desired. Other nonferrous alloys can be used, or ferrous alloys can be substituted if preferred. One particular advantage of aluminum alloys is that they can be anodized for improved appearance and surface hardness.

Simply by way of example, the following materials have been found suitable in one preferred embodiment. The bar 12, the hinge elements 24, and the handle bracket 32 can be extruded of an aluminum alloy such as 6061. Aluminum alloys can also be used for the handle, the handle lock, and the hinge plates.

It is therefore intended that the foregoing detailed description be regarded as illustrative rather than limiting, and that it be understood that it is the following claims, including all equivalents, which are intended to define the scope of this invention.

We claim:

1. A bar lock for securing a door in a closed position in a frame, said bar lock comprising:

a bar comprising a first non-circular interlocking profile extending along a length thereof;

first and second hinges; and first and second hinge elements, each hinge element included in a respective one of the hinges, each of the hinge elements comprising a second non-circular interlocking profile, said second interlocking profile shaped to mate with the first interlocking profile to restrict the hinge elements to axial movement along the length of the bar.

2. The bar lock of claim 1 further comprising at least first and second fasteners securing the bar to the first and second hinge elements, respectively, to prevent axial movement therebetween.

3. The bar lock of claim 2 wherein the fasteners are welds.

4. The bar lock of claim 1 wherein the bar additionally comprises a third non-circular interlocking profile extending along the length thereof, wherein the bar lock comprises a handle pivotably mounted to a handle bracket, said handle bracket comprising a fourth non-circular interlocking profile, said fourth non-circular interlocking profile shaped to mate with the third interlocking profile to restrict the handle bracket to axial movement along the length of the bar.

5. The bar lock of claim 4 further comprising at least a fastener securing the handle bracket to the bar.

6. The bar lock of claim 5 wherein the fastener comprises a weld.

7. The bar lock of claim 4 wherein the second and third interlocking profiles are substantially identical in shape.

8. The bar lock of claim 7 wherein the first and fourth interlocking profiles are substantially identical in shape.

9. The bar lock of claim 1 wherein one of the first and second interlocking profiles is shaped as a dovetail ridge and the other of the first and second interlocking profiles is shaped as a mating dovetail groove.

10. The bar lock of claim 1 wherein the bar comprises a metal extrusion, said extrusion comprising said first interlocking profile.

11. The bar lock of claim 1 wherein the bar and the hinge elements each comprise a respective metal extrusion, said extrusions all having a single cross-sectional shape.

12. The bar lock of claim 4 wherein the bar, the hinge elements and the handle bracket each comprise a respective aluminum extrusion.

13. The bar lock of claim 4 wherein the bar, the hinge elements and the handle bracket are formed of an aluminum alloy.

14. The bar lock of claim 1 wherein the bar comprises a resilient elastomeric strip affixed thereto and extending along the length of the bar to cushion contact between the bar and the door.

15. The bar lock of claim 14 wherein the elastomeric strip comprises at least one protruding ridge, and wherein the bar comprises an axially extending groove that receives the ridge.

* * * * *